US005101984A

United States Patent [19]

Shaw

[11] Patent Number: 5,101,984

[45] Date of Patent: Apr. 7, 1992

[54] RECYCLING TRASH BAG ARRANGEMENT

[76] Inventor: Lu Ann W. Shaw, 309 Park Ave., Florence, S.C. 29501

[21] Appl. No.: 705,392

[22] Filed: May 24, 1991

[51] Int. Cl.[5] ..... A47F 5/00

[52] U.S. Cl. ..... 211/12; 248/99

[58] Field of Search ..... 211/12, 71; 248/99, 248/100, 95

[56] References Cited

U.S. PATENT DOCUMENTS 4,802,647 2/1989 Celmayster et al. ..... 248/99 X
4,821,903 4/1989 Hayes .
4,874,111 10/1989 Heller .
4,957,252 9/1990 Watkins ..... 248/99 X
4,979,705 12/1990 Bovitz ..... 248/99 x
5,018,691 5/1991 King ..... 248/99
5,050,743 9/1991 Lazzarotti ..... 211/12

*Primary Examiner*—Robert W. Gibson, Jr.

[57] ABSTRACT

A trash recycling apparatus that includes a series of individual trash bags suspended from a racks structure in a row configuration. Exposed side wall areas of the bags have special trash identifier markings that enable a person standing in front of the rack structure to select the appropriate bag for each trash item. The identifier markings are written at an angle to permit the use of relatively large size lettering. Also the markings are repeated at vertically spaced points along the bag length to ensure readability of the markings.

3 Claims, 1 Drawing Sheet

RECYCLING TRASH BAG ARRANGEMENT

BACKGROUND AND SUMMARY OF THE INVENTION

This invention relates to an apparatus for classifying and storing recyclable trash, e.g. aluminum cans, waste paper and cardboard, newspapers, glass bottles, and plastic packaging materials.

U.S. Pat. No. 4,821,903 to J. Hayes shows a trash storage means that comprises a number of rectangular trash bins removably supported on a cart. The cart has a handle and two wheels for enabling the cart to be moved from one place to another in the home. The use of multiple bins permits the trash to be separated into different categories, e.g. cans, glass, plastics, etc.

U.S. Pat. No. 4,874,111 to C. Heller shows an internally partitioned housing that defines four upwardly opening compartments. Pins are adapted to be driven into holes in the upper edges of the housing walls to secure trash bags in the individual compartments. When it becomes necessary to remove a trash bag from its compartment the associated pins must be lifted or otherwise removed from the housing.

The present invention contemplates an open rack structure for removably suspending a plurality of individual trash bags alongside one another in a row-like configuration. Each bag is intended to contain a particular type of trash, e.g. aluminum cans, waste paper, newspapers, glass bottles, etc. Large letter size name identifications are printed on the individual bags for indicating the type of trash to be placed in each bag. The bag-suspension rack structure is designed so that all of the bags are simultaneously visible to a person facing the rack structure. The person is thus able to look at the printing on the various bags and quickly pick out the correct bag for each particular item of trash. The system minimizes mistakes that otherwise might be made in selecting the wrong trash bag for particular trash items. The printing on the bags is also advantageous when it becomes necessary to dispose of the recyclable trash, either by placing the bags at curbside or taking the bags to a recylcing center. The householder or trash pick-up person becomes instantly aware of the bag contents without having to open the bags.

THE DRAWINGS

DESCRIPTION OF A PREFERRED EMBODIMENT OF THE INVENTION

Figure 1:
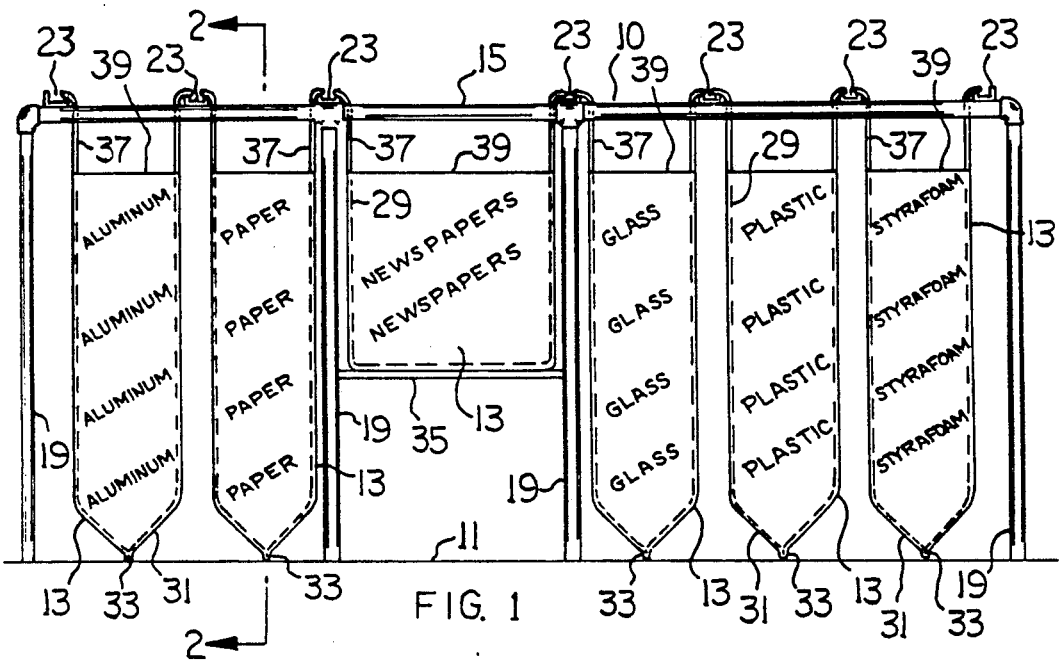
FIG. 1 is a front elevational view of a trash storing apparatus embodying the invention.
Figure 2:
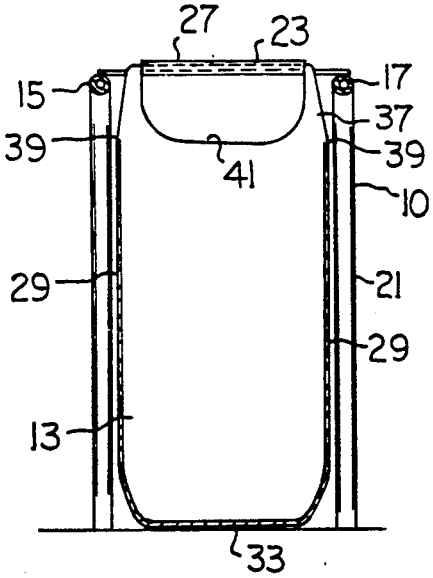
FIG. 2 is a transverse sectional view taken on line 2—2 in FIG. 1.
Figure 3:
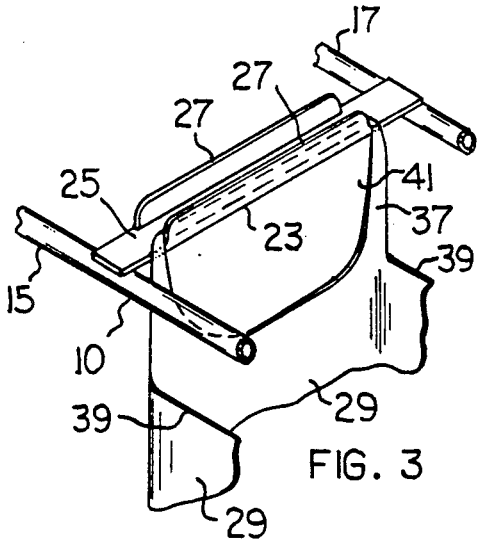
FIG. 3 is a fragmentary perspective view of a trash bag suspension device used in the FIG. 1 apparatus.

The drawings show a rack structure 10 supported on a floor surface 11 for suspending six individual trash bags 13 in open positions for placement of trash therein. The rack structure comprises a front horizontal plastic pipe 15 and a rear horizontal plastic pipe 17 (FIGS. 2 and 3). Pipe 15 is connected to four vertical plastic pipes 19. Pipe 17 is connected to four additional plastic pipes 21 (one of which is shown in FIG. 2). In FIG. 1 the four vertical pipes 21 would be located directly behind pipes 19.

Pipes 15 and 17 are interconnected by seven horizontal transverse bars 23. As best seen in FIG. 3, a representative one of the bars is comprised of a flat strip (or web) 25 and two upstanding ribs (or flanges) 27. Each rib acts as a suspension device for one of the trash bags. The trash bags are arranged alongside one another in a row configuration.

Each trash bag has an annular side wall 29 and a bottom wall 31. In the case of five of the trash bags, the bag structure is a generally tubular plastic film member having one end of the tube closed by a heat-sealed seam 33, thereby forming the bag bottom wall. In the case of the bag used to contain newspapers, the bag structure will be a paper bag similar to the paper bags used in supermarkets for containment of groceries; however the bag structure will be sized to receive newspapers in a vertically stacked orientation. The bag structure plan area can for example be twelve inches wide (as seen in FIG. 1) and fifteen inches deep (normal to the plane of the paper in FIG. 1). A shelf 35 will be attached to (between) four of the vertical pipes 19, 21 to support the weight of the newspapers placed into the paper bag.

Each bag 13 includes two integral handles 37 extending upwardly from the upper edge 39 of bag side wall 29 at diametrically spaced points therealong. Each handle 37 comprises an upstanding panel that forms a planar extension of the bag side wall; a relatively large hole 41 is formed in each panel so that the defined handle can be looped over one of the upstanding ribs 27 on a horizontal bar 23.

Each bag is suspended by two handles (looped over two ribs 27), such that each bag has a balanced suspension. Each rib 27 is relatively long so that the bag side walls tend to be flat (straight) for attainment of a relatively large rectangular bag top opening.

As an important feature of the invention, each bag has an identifying name of a recyclable material printed thereon. The printing in each case is tilted at an angle to the horizontal so that large size letters can be used even though the width dimension of the bag is relatively small, e.g. on the order of six inches in the case of five of the bags. A small width bag is desirable in that a relatively large number of bags ca then be used without taking up an excessively great amount of building wall space.

With the bags arranged in a row, as shown in FIG. 1, a person standing in front of the rack structure can simultaneously see the lettering on all of the bags. The person can thus quickly select the proper bag for any particular trash item.

The trash identifying names are repeated at vertically spaced points along the side wall of each bag. This feature enables the person to correctly read the wording even though the bag might be wrinkled or deformed at certain points along the bag length, e.g. near the bag bottom or at points above the bag bottom. The bag will be relatively flat at some points along its length, such that the person can correctly read the bag message.

It is intended that the rack structure will be located at any convenient point in the person's residence, e.g. in the garage, or in the kitchen, or in a storage room or closet. When the bags are filled they can be removed from the rack structure by disengaging the bag handles 37 from bars 25; the handles on any bag can be tied together to close the bag and retain the trash against escape while the bag is being placed at the curb for pick-up or while the bag is being transported to a recycling center. The large size trash identifier lettering on each bag is advantageous in that the person handling the bag quickly becomes aware of the bag contents without having to open the bag. The bag lettering thus is a important feature of the invention.

What is claimed is:

1. An apparatus for temporarily storing recylcable trash, comprising: an upstanding rack structure that includes a plurality of spaced parallel horizontal bars, each bar having an upstanding rib extending therealong; and a row of trash bags suspended from the rack structure, each bag having an annular side wall and two integral handles extending upwardly from the upper edges of the side wall at diametrically spaced points therealong, each handle comprising an upstanding panel having a relatively large hole therethrough, whereby the handle can be looped over an upstanding rib on one of said horizontal bars; each bag having its handles looped over ribs on adjacent bars such that each set of handles provides a balanced suspension for the associated bag; each bag having an identifying name of a recylcable material printed thereon; the identifying name being located on each bag so that all of the identifying names are simultaneously visible to a person facing the rack structure.

2. The apparatus of claim 1, wherein each identifying name is repeated at vertically spaced points along the side wall of the associated bag.

3. The apparatus of claim 2, wherein the identifying names are tilted so that relatively large letters can be used for the names.

* * * * *